US007905750B2

(12) United States Patent
Mo

(10) Patent No.: US 7,905,750 B2
(45) Date of Patent: Mar. 15, 2011

(54) ELECTRIC CONNECTOR WITH A BLUETOOTH DEVICE THEREIN

(75) Inventor: Chia-Ping Mo, Keelung (TW)

(73) Assignee: Ajoho Enterise Co., Ltd., Taipei (TW)

( * ) Notice: Subject to any disclaimer, the term of this patent is extended or adjusted under 35 U.S.C. 154(b) by 104 days.

(21) Appl. No.: 12/502,530

(22) Filed: Jul. 14, 2009

(65) Prior Publication Data

US 2010/0267255 A1 Oct. 21, 2010

(30) Foreign Application Priority Data

Apr. 17, 2009 (TW) ..... 98206478 U

(51) Int. Cl.
*H01R 13/60* (2006.01)

(52) U.S. Cl. ..... 439/541.5; 439/660; 439/916

(58) Field of Classification Search ..... 439/541.5, 439/540.1, 74, 79, 916, 639, 660, 620.15, 439/620.18
See application file for complete search history.

(56) References Cited

U.S. PATENT DOCUMENTS

| | | | | |
|---|---|---|---|---|
| 6,099,351 | A * | 8/2000 | Wu | 439/607.43 |
| 6,200,161 | B1 * | 3/2001 | McClinton et al. | 439/541.5 |
| 6,417,812 | B1 * | 7/2002 | Tsai | 343/725 |
| 6,516,202 | B1 * | 2/2003 | Hawkins et al. | 455/556.2 |
| 7,588,445 | B2 * | 9/2009 | He et al. | 439/79 |
| 7,604,490 | B2 * | 10/2009 | Chen et al. | 439/79 |
| 2010/0159748 | A1 * | 6/2010 | Chang | 439/620.22 |

* cited by examiner

*Primary Examiner* — Xuong M Chung Trans
(74) *Attorney, Agent, or Firm* — Muncy, Geissler, Olds & Lowe, PLLC

(57) ABSTRACT

An electric connector includes an electrically insulative housing, which has connector receiving chambers and an accommodation space arranged in a stack, metal terminals respectively mounted in the connector receiving chambers, the metal terminals each having a front contact end respectively extended to an insertion slot on the front side of each connector receiving chamber for the contact of an external electric connector and a rear bonding portion extended out of the bottom side of the electrically insulative housing for bonding to an external circuit board, and a Bluetooth device mounted in the accommodation space for receiving an external wireless signal, and a metal shield capped on the electrically insulative housing for EMI protection.

8 Claims, 5 Drawing Sheets

ELECTRIC CONNECTOR WITH A BLUETOOTH DEVICE THEREIN

This application claims the priority benefit of Taiwan patent application number 098206478 filed on Apr. 17, 2009.

BACKGROUND OF THE INVENTION

1. Field of the Invention

The present invention relates to electric connectors and more particularly, to an electric connector, which has vertically spaced insertion slots for the insertion of external electric connectors into respective connector receiving chambers to contact respective metal terminals for wired signal transmission, and a Bluetooth device mounted in an accommodation space at the top side of the connector receiving chambers for receiving an external wireless signal.

2. Description of the Related Art

Following the step of technology era, many consumer electric and electronic products and home electric appliances are computerized. When using a computerized product, a user may need to input signals for startup, shutoff, setting control. For example, when operating an old design of TV, stereo system, video recorder/player, MOD (multimedia on demand) device, multimedia player, air-conditioner, intelligent refrigerator, computer, mobile telephone, notebook computer or any of a variety of other electric devices, a user need to click the buttons on the housing or an extension operating bar of the electric device directly. However, advanced electric devices commonly provide a remote control function. By means of RF (radio frequency), infrared or Bluetooth transmission technology, a user can control the operation of an electric device at a remote site.

Further, many electric connectors, such as USB connectors, SATA connectors, eSATA connectors, RJ connectors, Mini USB connectors are created and intensively used for the connection of peripheral apparatus to a master unit. For example, different electric connectors may be used for the connection of video recorder/player, MOD device, speakers, stereo system, computer and/or digital camera to a digital TV, or for the connection of keyboard, mouse, printer, TV signal receiver and/or modem to a computer. By means of connectors, multiple slave devices can be connected to a master device for transmitting data signal or storing data.

Further, signal transmission through electric/electronic devices can be done by means of wired or wireless techniques. Either providing a wired transmission function or wireless transmission function, linking of electric connectors allows two-way signal transmission between two parties. Therefore, electric/electronic devices generally have a number of electric connectors and/or a wireless transmitter and receiver module for communication with external electric/electronic devices. However, in actual practice, conventional designs still have drawbacks as follows:

1. Installation of electric connectors and/or signal transmission devices in the internal circuit board of an electric/electronic device occupies much circuit board space, interfering with circuit layout of the circuit board.

2. For enabling an electric/electronic device to receive an external wireless signal, an attached antenna or attached signal transducer means is necessary. The installation of such an attached antenna or attached signal transducer means requires much installation space. Further, when an attached antenna or attached signal transducer means is used, the internal circuit board of the electric/electronic device must have a signal adapter means to convert external wireless signal into a specific format for reading or storage. The installation of such a signal adapter means requires an extra circuit board space.

Accordingly, there is a need for an electric connector that provides wired and wireless signal transmission functions and, that has the characteristic of small size.

SUMMARY OF THE INVENTION

The present invention has been accomplished under the circumstances in view. It is one object of the present invention to provide an electric connector, which is practical for wired signal transmission as well as wireless signal transmission. It is another object of the present invention to provide an electric connector for wired and wireless signal transmission, which has the characteristic of small size To achieve these and other objects of the present invention, the electric connector comprises an electrically insulative housing, which has multiple connector receiving chambers arranged at different elevations, an accommodation space disposed at the top side relative to the connector receiving chamber, and an insertion slot located on the front side of each connector receiving chamber for the insertion of an external electric connector into the associating connector receiving chambers, metal terminals respectively mounted in the connector receiving chambers for the contact of metal terminals of an external electric connector, a Bluetooth device mounted in the accommodation space and having a signal receiving portion protruding over the front side of the electrically insulative housing for receiving an external wireless signal, and a metal shield capped on the electrically insulative housing for EMI (electromagnetic interference) protection.

Further, the connector receiving chambers and the respective insertion slots and metal terminals can be configured to fit USB connectors, SATA connectors, eSATA connectors or RJ connectors for wired signal transmission.

DETAILED DESCRIPTION OF THE PREFERRED EMBODIMENT

Figure 1:
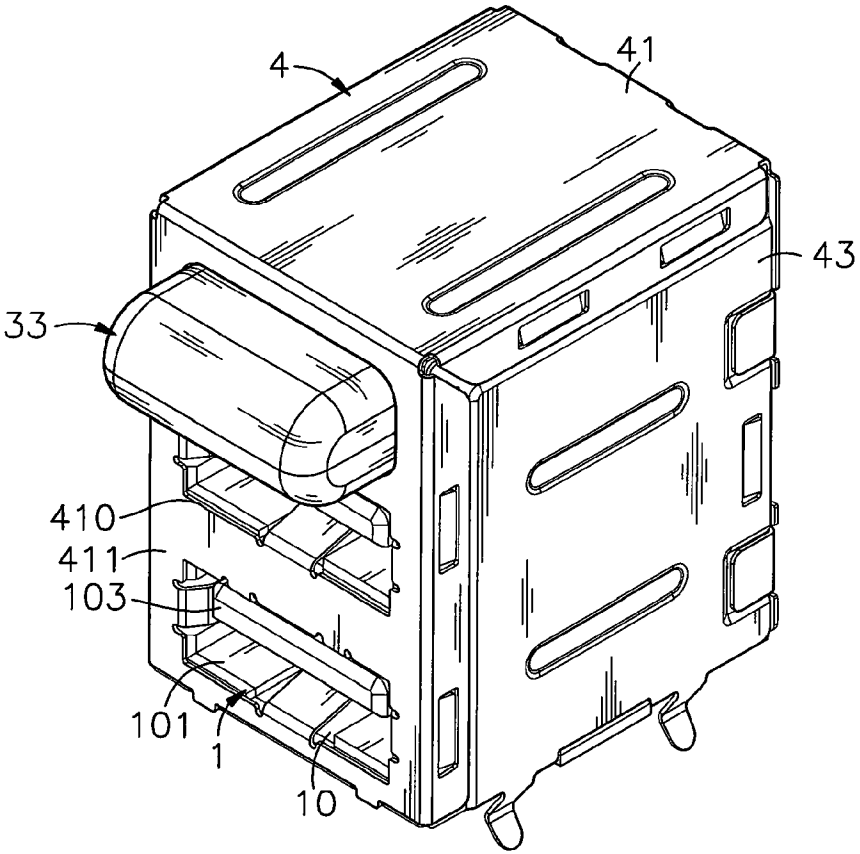
FIG. 1 is an elevational view of an electric connector in accordance with the present invention.
Figure 2:
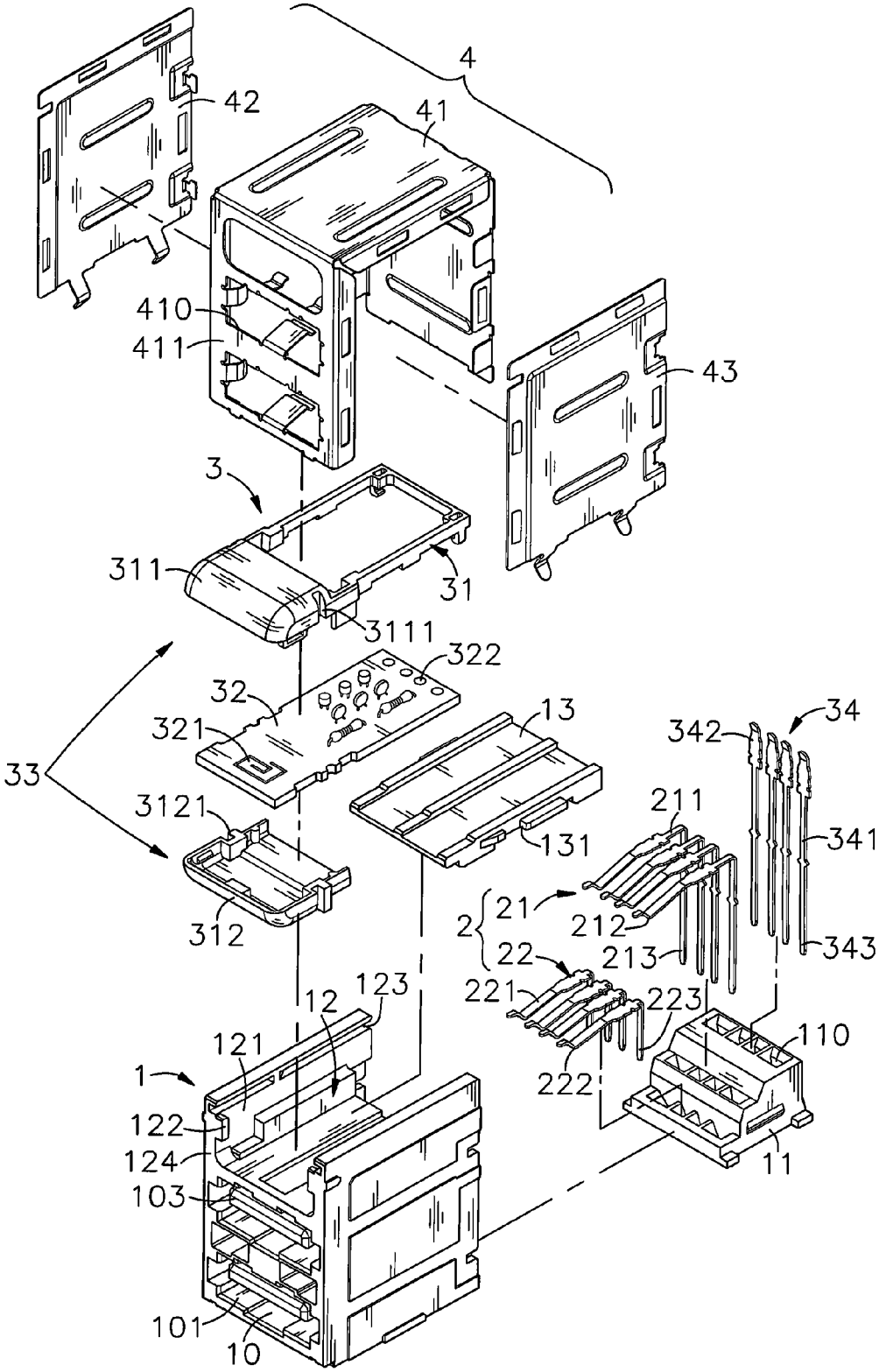
FIG. 2 is an exploded view of the electric connector in accordance with the present invention.
Figure 3:
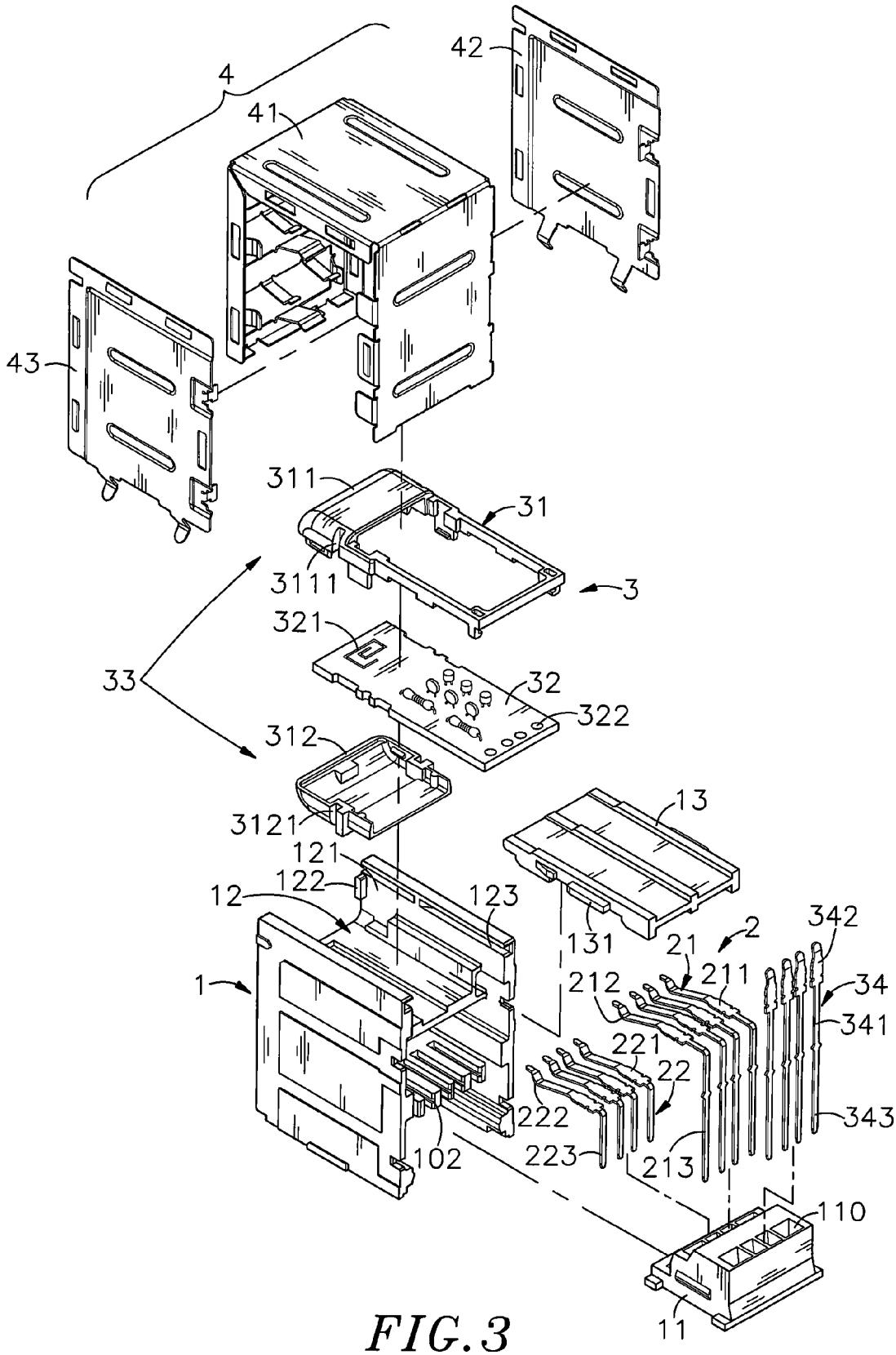
FIG. 3 corresponds to FIG. 2 when viewed from the rear side.
Figure 4:
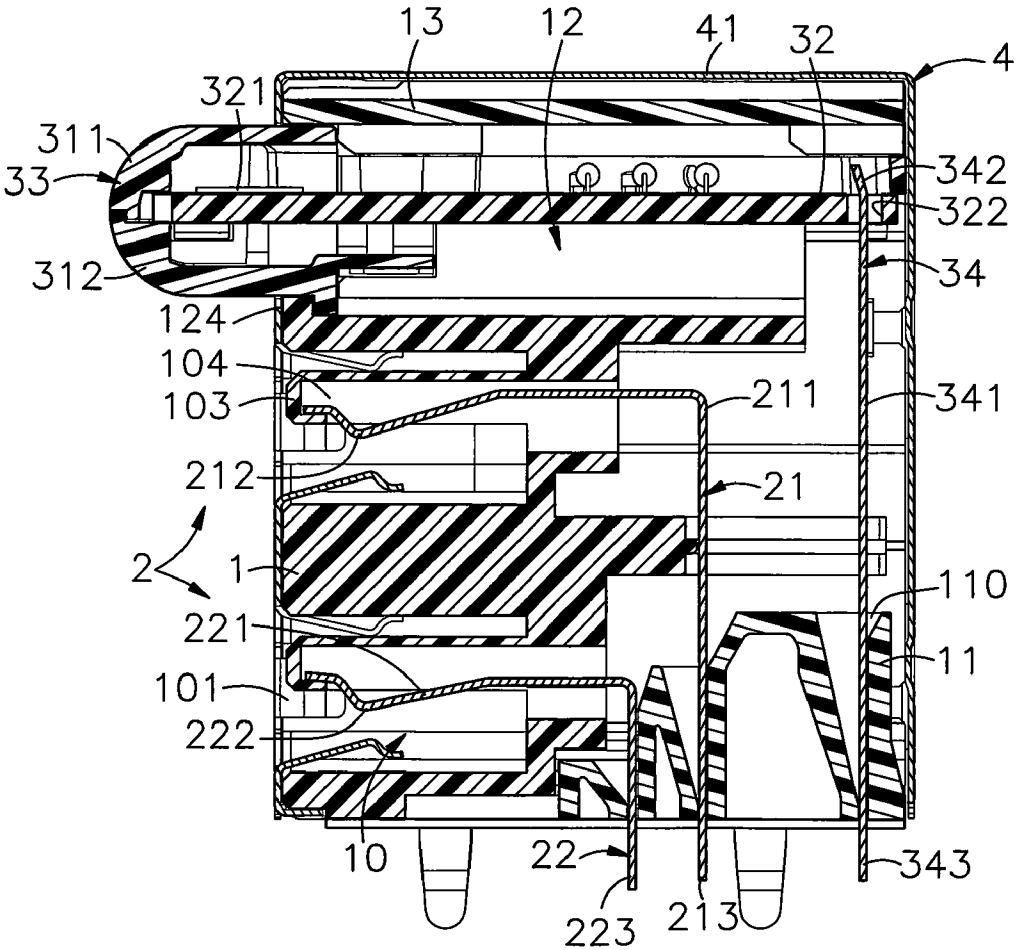
FIG. 4 is a sectional side view of the electric connector in accordance with the present invention.

Referring to FIGS. 1~4, an electric connector is shown comprising an electrically insulative housing 1, multiple metal terminal sets 2, a Bluetooth device 3 and a metal shield 4.

The electrically insulative housing 1 has a plurality of connector receiving chambers 10 defined therein at different elevations, insertion slots 101 respectively formed in the front side thereof in communication with the connector receiving chambers 10, terminal holes 102 respectively disposed at a rear side relative to the connector receiving chambers 10, a locating block 11 mounted in the bottom side thereof below the terminal holes 102 and having multiple rows of vertical through holes 110, an accommodation space 12 defined above the connector receiving chambers 10, two retaining lugs 122 respectively protruded from two opposite sidewalls 121 of the accommodation space 12 and bilaterally disposed at the front side 124 of the accommodation space 12 near the top, and two locating grooves 123 bilaterally formed in the top side of the accommodation space 12 at an elevation above the retaining lugs 122.

The metal terminal sets 2 include a first metal terminal set 21 formed of a plurality of first metal terminals 211, and a second metal terminal set 22 formed of a plurality of second metal terminals 221. Each first metal terminal 211 or second metal terminal 221 has a contact portion 212 or 222 at one end and a bonding portion 213 or 223 at the other end.

The Bluetooth device 3 comprises a casing 31, a circuit module 32 mounted inside the casing 31, and an adapter terminal set 34. The casing 31 is formed of a top shell 311 and a bottom shell 312. The top shell 311 has a plurality of retaining grooves 3111. The bottom shell 312 has a plurality of retaining grooves 3121. The circuit module 32 is a circuit board having a circuit layout thereon. Further, the circuit module 32 comprises a wireless antenna 321 disposed near the front side thereof, and a set of via holes 322 arranged along the rear side thereof. The adapter terminal set 34 comprises a plurality of metal adapter terminals 341, each having a connection portion 342 at one end and a bonding portion 343 at the other end. The connection portions 342 of the metal adapter terminals 341 are respectively electrically bonded to the via holes 322 of the circuit module 32. Further, the wireless antenna 321 and the front part of the casing 31 form a signal receiving portion 33.

The metal shield 4 comprises a substantially ⊓-shaped main shielding frame 41 and two lateral shielding panels 42 and 43. The ⊓-shaped main shielding frame 41 has a plurality of openings 410 cut through a front wall 411 thereof.

During the assembly process of the electric connector, the first metal terminals 211 of the first metal terminal set 21 and the second metal terminals 221 of the second metal terminal set 22 are respectively mounted in the connector receiving chambers 10 of the electrically insulative housing 1 to have the respective contact portions 212 and 222 be extended to the insertion slots 101 and the respective bonding portions 213 and 223 be respectively extended through the terminal holes 102 and then bent downwards and inserted through corresponding rows of through holes 110 of the locating block 11 for bonding to an external circuit board (not shown), and then the Bluetooth device 3 is inserted into the accommodation space 12 of the electrically insulative housing 1 to force the retaining grooves 3111 and 3121 into engagement with the retaining lugs 122 of the electrically insulative housing 1 for enabling the signal receiving portion 33 of the Bluetooth device 3 to extend out of the front side 124 of the accommodation space 12 and the bonding portions 343 of the metal adapter terminals 341 of the adapter terminal set 34 be inserted through a corresponding row of through holes 110 of the locating block 11 for bonding to the same external circuit board to which the bonding portions 213 and 223 are bonded. Thereafter, the metal shield 4 is capped on the electrically insulative housing 1 to let the signal receiving portion 33 be inserted through one opening 410 on the front wall 411 of the ⊓-shaped main shielding frame 41 and each insertion slot 101 be aimed at one respective opening 410 of the ⊓-shaped main shielding frame 41. When assembled, the ⊓-shaped main shielding frame 41 shields the top, front and rear sides of the electrically insulative housing 1, and the two lateral shielding panels 42 and 43 shield the two opposite lateral sides of the electrically insulative housing 1.

The accommodation space 12 of the electrically insulative housing 1 is an open space having an open top side. Before installation of the metal shield 4, an electrically insulative top cover plate 13 is mounted in the electrically insulative housing 1 to cover the open top side of the accommodation space 12. The electrically insulative top cover plate 13 has two rails 131 symmetrically disposed at two opposite lateral sides thereof and respectively engaged into the locating grooves 123 of the electrically insulative housing 1. After installation of the electrically insulative top cover plate 13 in the electrically insulative housing 1, the electrically insulative top cover plate 13 stops the Bluetooth device 3 from upward displacement. Further, because the retaining grooves 3111 and 3121 of the Bluetooth device 3 are respectively forced into engagement with the retaining lugs 122 of the electrically insulative housing 1, the Bluetooth device 3 is prohibited from horizontal displacement. Therefore, the Bluetooth device 3 is prohibited from movement in horizontal or vertical direction after its installation in the electrically insulative housing 1. Further, as an alternate form of the present invention, the electrically insulative top cover plate 13 can be formed integrally with the top side of the accommodation space 12 of the electrically insulative housing 1 for enabling the Bluetooth device 3 be positively accommodated in the accommodation space 12 with the signal receiving portion 33 extended out of out of the front side 124 of the accommodation space 12 of the electrically insulative housing 1 for receiving an external wireless signal.

Figure 5:
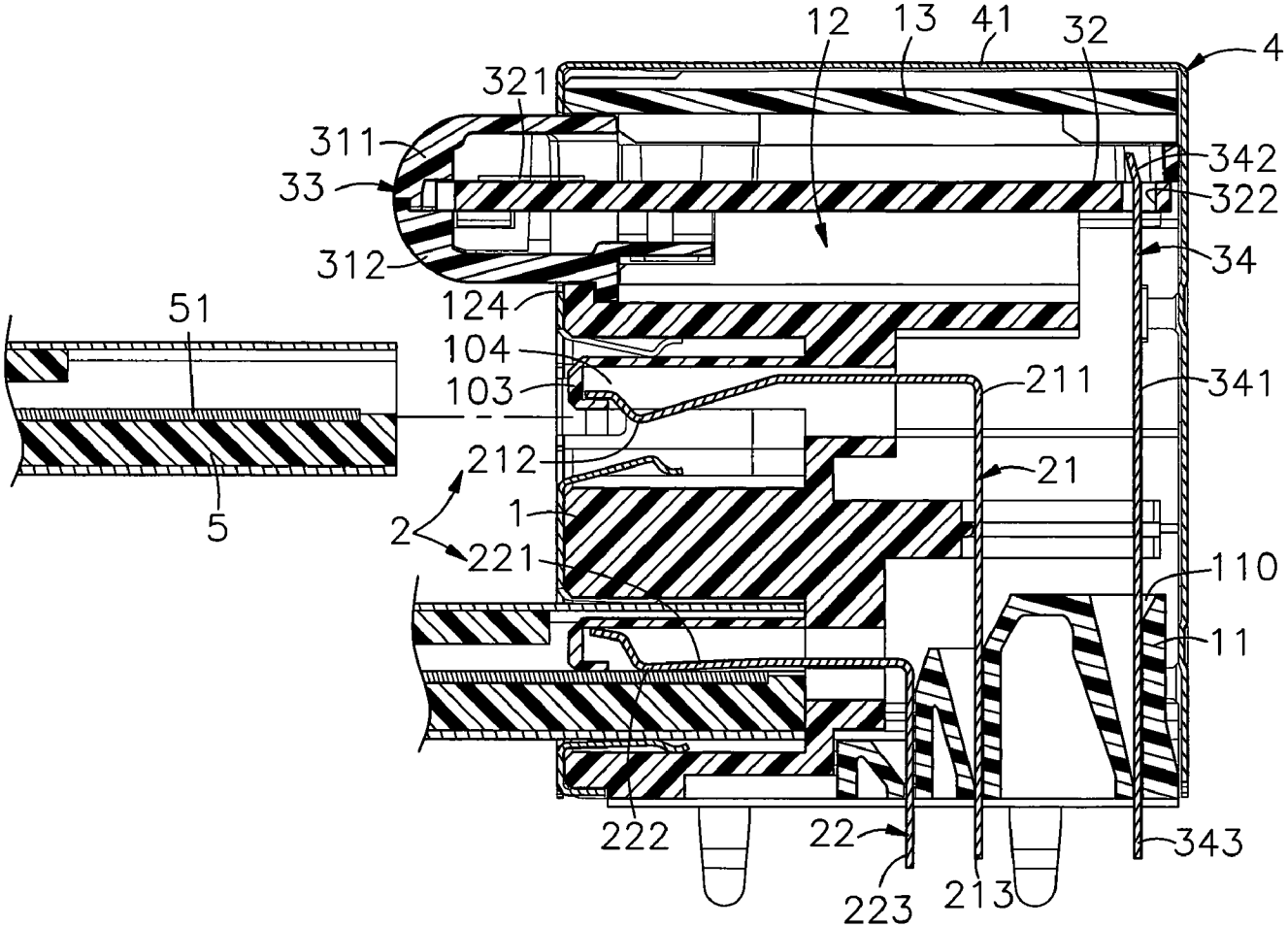
FIG. 5 is a schematic sectional view of the present invention, showing a status of use of the electric connector.

Referring to FIG. 5 and FIGS. 2~4 again, the accommodation space 12 and the connector receiving chambers 10 are arranged in a stack so that the dimension of the electric connector can be minimized. Further, the insertion slots 101 and the connector receiving chambers 10 may be configured for receiving a USB connector, a Mini USB connector, a SATA connector or an eSATA connector respectively. Further, the electrically insulative housing 1 can be made having a tongue plate 103 horizontally suspending in each slot 101. The tongue plate 103 has a plurality of terminal holes 104 for the passing of the contact portions 212 or 222 of the metal terminals 211 or 221. When an external electric connector 5 is inserted through one opening 410 of the meta shield 4 and the slot 101 of the one connector receiving chamber 10 of the electrically insulative housing 1, the signal terminals 51 of the external electric connector 5 are respectively forced into contact with the contact portions 212 or 222 of the corresponding metal terminals 211 or 221 for signal transmission. Further, the signal receiving portion 33 of the Bluetooth device 3 extends out of the accommodation space 12 of the electrically insulative housing 1 for receiving an external signal wirelessly. Thus, the electric connector of the present invention is practical for wired and wireless signal transmission.

Further the connector receiving chambers 10 of the electrically insulative housing 1 can be configured to receive a RJ standard connector, an Ethernet connector, or a coaxial cable connector.

The aforesaid description simply describes one simple of the present invention but not intended as a limitation of the present invention By means of defining a plurality of connector receiving chambers 10 and an accommodation space 12 in the electrically insulative housing 1 at different elevations and mounting a Bluetooth device 3 in the accommodation space 12 to have the signal receiving portion 33 of the Bluetooth device 3 be exposed to the outside of the electrically insulative housing, the electric connector is practical for wired and wireless signal transmission. Further, the connector receiving chambers 10 can be configured to fit any of a variety of electric connectors. Further, by means of arranging the connector receiving chambers 10 and an accommodation space 12 in a stack, the dimension of the electric connector is minimized.

In conclusion, the invention provides an electric connector with a Bluetooth device therein, which has the following advantages and features:

1. The electrically insulative housing 1 has a plurality of connector receiving chambers 10 arranged at different elevations and configured to fit different connector standards for receiving different electric connectors, and an accommodation space 12 arranged on the top side of the connector receiving chambers 10 for accommodating a Bluetooth device 3. This stacked design of the connector receiving chambers 10 and the accommodation space 12 facilitates circuit board arrangement, saving much circuit board installation space.

2. The connector receiving chambers 10 of the electrically insulative housing 1 are adapted for receiving different stands of electric connectors. Further, because the Bluetooth device 3 is mounted in the accommodation space 12 above the connector receiving chambers 10, the installation of the Bluetooth device 3 does not occupy any connector receiving chamber 10 and, the Bluetooth device 3 can receive an external wireless signal directly without through any signal adapter means.

As stated above, the electric connector in accordance with the present invention has a Bluetooth device and electric connector receiving structures arranged in a stack to minimize the size and to achieve wired and wireless signal transmission.

A prototype of electric connector has been constructed with the features of FIGS. 1~5. The electric connector has a Bluetooth device and electric connector receiving structures arranged in a stack to minimize the size and to achieve wired and wireless signal transmission.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric connector, comprising:

an electrically insulative housing, said electrically insulative housing having a plurality of connector receiving chambers defined therein and respectively accommodating a respective set of metal terminals, a plurality of insertion slots formed in a front side thereof and respectively disposed in communication with said connector receiving chambers, an accommodation space disposed outside said connector receiving chambers, and two retaining lugs bilaterally disposed at a front side of said accommodation space; and a Bluetooth device mounted in said accommodation space of said electrically insulative housing and partially extending out of the front side of said electrically insulative housing for receiving an external wireless signal, said Bluetooth device comprising a casing mounted in said accommodation space and forced into engagement with said retaining lugs, said casing having a signal receiving portion extending out of the front side of said electrically insulative housing, a circuit module mounted inside said casing, a wireless antenna electrically connected to said circuit module and disposed inside said signal receiving portion of said casing for receiving an external wireless signal, and a plurality of metal adapter terminals electrically extended from said circuit module through a bottom side of said electrically insulative housing for bonding to an external circuit board.

2. The electric connector as claimed in claim 1, wherein said connector receiving chambers and the metal terminals accommodated in said connector receiving chambers are configured to fit at least one of USB, Mini USB, SATA and eSATA standards; said electrically insulative housing has at least one tongue plate suspending in said connector receiving chambers, each said tongue plate having a plurality of terminal holes for the passing of the metal terminals that are mounted in the associating connector receiving chamber.

3. The electric connector as claimed in claim 1, wherein the metal terminals that are mounted in said connector receiving chambers are configured subject to one of RJ connector standards, Ethernet connector standards and coaxial cable connector standards.

4. The electric connector as claimed in claim 1, wherein said accommodation space and said connector receiving chambers are arranged in a stack; said accommodation space has an open side; said electrically insulative housing further comprises an electrically insulative top cover plate that covers the open top side of said accommodation space.

5. The electric connector as claimed in claim 1, wherein said circuit module of said Bluetooth device is a circuit board having said wireless antenna arranged on a front side thereof and a plurality of via holes arranged on a rear side thereof for the mounting of said metal adapter terminals.

6. The electric connector as claimed in claim 1, wherein said casing of said Bluetooth device comprises two retaining grooves respectively forced into engagement with the retaining lugs of said electrically insulative housing.

7. The electric connector as claimed in claim 1, wherein said electrically insulative housing has an electrically insulative locating block mounted in the bottom side thereof, said electrically insulative locating block having multiple rows of through holes; the metal terminals that are mounted in said connector receiving chambers and the metal adapter terminals of said Bluetooth device each having a bottom bonding portion respectively inserted through the through holes of said electrically insulative locating for bonding to an external circuit board.

8. The electric connector as claimed in claim 1, further comprising a metal shield capped on said electrically insulative housing, said metal shield comprising a substantially ⊓-shaped main shielding frame and two lateral shielding panels, said ⊓-shaped main shielding frame having a plurality of openings cut through a front wall thereof corresponding to said insertion slots of said electrically insulative housing.

* * * * *